United States Patent [19]

Welsch et al.

[11] 4,237,659

[45] Dec. 9, 1980

[54] QUICK CHANGE ADAPTER FOR MOUNTING ROTATABLE GRINDING ELEMENTS

[75] Inventors: Walter N. Welsch, Tonawanda; Elwin H. Fleckenstein, Alden, both of N.Y.

[73] Assignee: Dynabrade, Inc., Tonawanda, N.Y.

[21] Appl. No.: 22,736

[22] Filed: Mar. 22, 1979

[51] Int. Cl.[3] ..... B24B 45/00

[52] U.S. Cl. ..... 51/168; 279/1 B

[58] Field of Search ..... 51/DIG. 12, 168; 279/99, 1 A, 1 B, 106, 8

[56] References Cited

U.S. PATENT DOCUMENTS

| | | | |
|---|---|---|---|
| 1,106,894 | 8/1914 | Samphere | 51/168 |
| 1,333,054 | 3/1920 | Abbott | 51/DIG. 12 |
| 1,417,584 | 5/1922 | Stempel | 51/DIG. 12 |
| 1,501,269 | 7/1924 | Canning | 51/DIG. 12 |
| 2,286,292 | 6/1942 | Mall | 51/DIG. 12 |
| 3,691,900 | 9/1972 | Novak et al. | 51/168 |

*Primary Examiner*—Othell M. Simpson
*Assistant Examiner*—Roscoe V. Parker
*Attorney, Agent, or Firm*—Bean, Kauffman & Bean

[57] ABSTRACT

An adapter is provided to facilitate quick change mounting of rotatable grinding elements without the use of a tool, such as a wrench or key.

8 Claims, 7 Drawing Figures

QUICK CHANGE ADAPTER FOR MOUNTING ROTATABLE GRINDING ELEMENTS

BACKGROUND OF THE INVENTION

The present invention is directed towards an adapter for mounting rotatable grinding elements, such as for instance grinding wheels, mounted points, sanding discs and wire brushes relative to a source of power.

Grinding elements are commonly provided with a centrally located through aperture sized to receive a drive shaft to which such grinding element is clamped for rotation by suitable means, such as by a threaded clamping nut. Such drive shaft is either permanently coupled to a drive motor or removably coupled via a collet or chuck to a portable powered tool. A drawback of this type of arrangement is that a separate tool, such as a wrench or key is normally required for removably mounting the grinding element on the drive shaft.

Alternatively, grinding elements, such as mounted points, are formed with permanently attached drive shafts, which are adapted to be removably coupled to a portable power tool by means of a collet.

SUMMARY OF THE INVENTION

The present invention is directed towards an adapter providing for quick change removable mounting of a rotatable grinding element relative to a source of power without the need for employing a separate tool.

The present invention is particularly adapted for use in mounting grinding elements of the type formed with a through aperture and intended to be removably mounted on a drive shaft, but possesses utility in mounting grinding elements of the type having a permanently attached drive shaft.

More specifically, an adapter formed in accordance with a preferred form of the present invention comprises in combination a drive shaft in the form of a mounting bolt having a screw threaded shank portion, which is adapted to be removably inserted through the through aperture of the grinding element; a fixture housing having a mounting opening sized to slidably receive the bolt shank portion and manually operated locking jaws arranged to removably engage with the screw threads; and a resiliently deformable member carried by the fixture housing for engagement with the grinding element incident to insertion of the bolt into the mounting opening for engagement with the locking jaws. With this construction, a grinding element may be locked for rotation with the fixture housing and thus a source of power to which the fixture housing is suitably connected by inserting the bolt into the fixture housing by an amount sufficient to effect resilient deformation of the resiliently deformable member and thereby provide a bias acting axially of the bolt for maintaining the screw threads in firm seating engagement with the locking jaws. Preferably, the insertion/locking procedure involves applying finger pressure to the locking jaws to place same in their release positions during manual insertion of the bolt into the mounting opening in order to avoid wearing engagement between the jaws and the screw threads; releasing the jaws to permit same to assume their normal locking position in engagement with the screw threads of the inserted bolt; and finally using hand pressure to force the grinding element axially towards the fixture housing to compress the resiliently deformable member, while simultaneously imparting a slight clockwise directed rotational movement to both the grinding element and bolt. Alternatively, the insertion/locking procedure may be effected by simply striking the head portion of the bolt against a solid object, such as a work bench, to force the bolt into the mounting opening by an amount sufficient to compress the resiliently deformable member.

Removal of the grinding element may be effected by applying hand pressure to the grinding element in order to effect further deformation of the resiliently deformable member by that extent required to remove the resilient bias induced frictional coupling between the screw threads and the jaws and thereafter imparting a slight counter-clockwise rotational movement to the grinding element in order to unthread the bolt by an amount sufficient to permit the resiliently deformable member to return to its non-deformed state when pressure is released from the grinding element. Thereafter, the jaws may be easily moved by finger pressure to their release position and the bolt simply pulled out of the fixture housing. The degree of turning movements required to be imparted to the grinding element, during the locking and unlocking operations, will depend on design of the screw threads and the hardness of the resiliently deformable member. However, for the case where the resiliently deformable member is a relatively soft rubber deformable under finger pressure and the bolt is a typical machine bolt, rotations of less than 90° are required to properly perform these operations.

DRAWINGS

The nature and mode of operation of the present invention will now be more fully described in the following detailed description taken with the accompanying drawings wherein.

DETAILED DESCRIPTION

Figure 1:
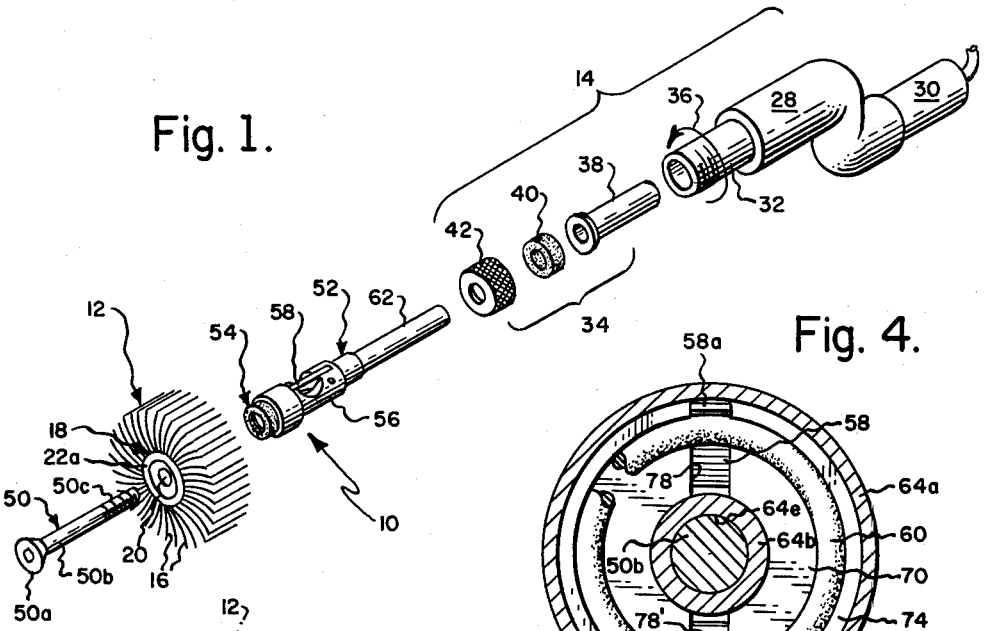
FIG. 1 is an exploded perspective view showing the adapter of the present invention in association with a grinding element and a pneumatically operated power tool.

Reference is first made to FIG. 1, wherein an adapter formed in accordance with a preferred form of the present invention is generally designated as 10 and shown in association with the grinding element 12 and a power source 14.

As by way of illustration, grinding element 12 is shown in FIG. 1 as being in the form of a commercially available "flap" abrasive wheel defined by a plurality of coated abrasive sheets or "flaps" 16, which have their radial inner ends bonded together and fixed to a mounting hub 18. Mounting hub 18 serves to define a through aperture 20 and oppositely facing mounting or clamping surfaces **22*a* and 22*b*. It will be noted that in the illustrated construction, mounting surfaces 22***a* and 22*b* include frusto-conically shaped portions 22*a'* and 22*b'*, which are aligned with aperture 20.

Also, for purposes of illustration, power source 14 is shown in FIG. 1 as being in the form of a pneumatic powered hand tool of the type described in U.S. Pat. No. 3,871,138. This tool generally includes a tool housing 28 mounting an air motor 30 and a rotary drive tube 32; and a locking device 34 for releasably mounting adapter 10 for rotation with drive tube 32 in a normal right hand direction, as indicated by arrow 36. Locking device 34 may include a reducing sleeve insert 38 sized for insertion within drive tube 32; a resiliently deformable washer-shaped member 40; and an apertured cup-shaped clamping member 42, which is threadably mounted on the outer end of drive tube 32 for the purpose of clamping adapter 10 within the reducing sleeve insert 38 for rotation with the drive tube.

Figure 2:
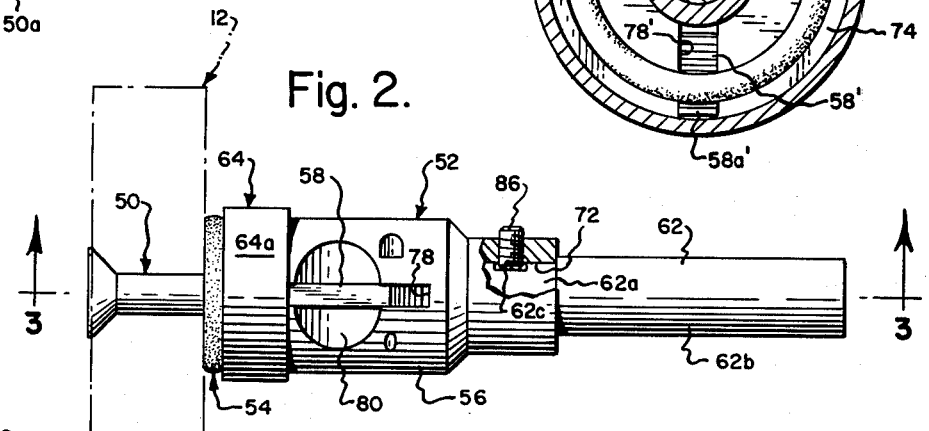
FIG. 2 is a top plan view of the adapter.
Figure 3:
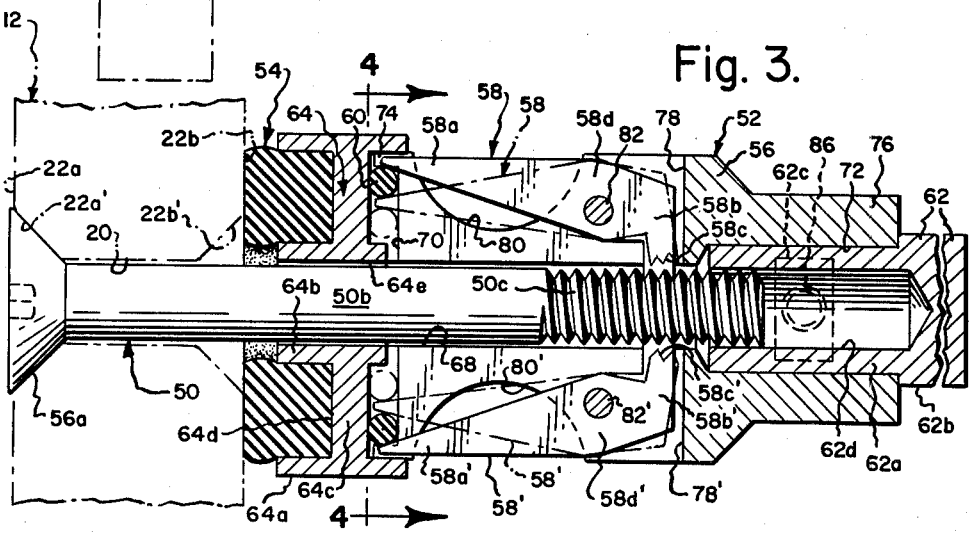
FIG. 3 is a sectional view taken generally along the line 3—3 in FIG. 2.

Adapter 10 is best shown in FIGS. 1, 2 and 3 as generally including a grinding element drive shaft, such as may be defined by a commercially available machine bolt 50, a mounting fixture 52 and a member 54 formed of a resiliently deformable material, such as rubber. Bolt 50 is considered as including a clamping head portion 50*a* and a shank portion 50*b*, which is sized to be slidably inserted through aperture 20 and preferably formed with right hand screw threads 50*c*. A bolt having a frusto-conically shaped head portion was chosen for use with the illustrated grinding element construction to permit seating of head portion 50*a* within mounting surface recess 22*a'* in order to provide a greater degree of concentricity between grinding element and the bolt than would normally be provided by the relatively loose slide fit of shank portion 50*b* within aperture 20. However, a drive shaft defined by bolts having geometries differing from that illustrated may be used depending upon the type and construction of the grinding element to be supported, and moreover, it is contemplated that certain conventional "screw" type threaded fasteners may be used in place of a bolt having a shank portion of uniform cross section throughout its length.

Figure 4:
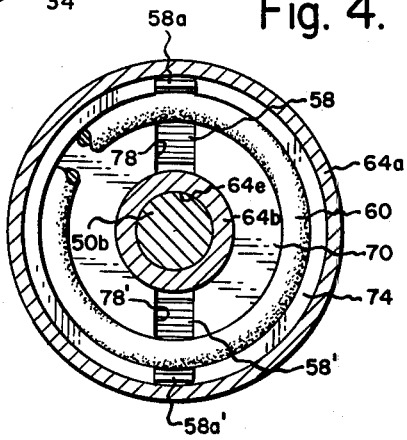
FIG. 4 is a sectional view taken generally along the line 4—4 in FIG. 3.

Fixture 52 is best shown in FIGS. 2–4 as generally including a housing or main body portion 56; a bolt locking or retaining means, such as may be defined by a pair of jaws 58 and 58'; spring means, such as may be defined by a resiliently deformable O-ring 60; means for connecting the fixture to power source 14, such as may include an arbor or spindle 62; and an end cap 64. More specifically, housing 56 is formed with an axially extending mounting opening 68, which is sized to slidably receive bolt shank portion 50*b*; forwardly and rearwardly opening recesses 70 and 72, which are disposed in communication with the front and rear ends of mounting opening 68 and radially bounded by front and rear rim portions 74 and 76, respectively; a pair of aligned and radially outwardly opening slots 78 and 78', which are sized to freely receive jaws 58 and 58', respectively; and jaw access facility recesses 80 and 80', which are bisected by slots 78 and 78', respectively. As best shown in FIG. 3, slots 78 and 78' extend lengthwise of mounting opening 68 in communication therewith and forwardly opening recess 70.

Jaws 58 and 58' are shown in FIG. 3 as being of generally L-shaped configuration and as having manually operable front end portions 58*a* and 58*a'*, which are arranged to project forwardly into recess 70; rear end portions 58*b* and 58*b'*, which serves to define tooth elements 58*c* and 58*c'*; and intermediate portions 58*d* and 58*d'*, which are apertured to receive pivot pins 82 and 82'.

O-ring 60 is shown in FIGS. 3 and 4 as being disposed within forwardly opening recess 70 for engagement with jaw front end portions 58*a* and 58*a'* in order to normally bias jaws 58 and 58' to assume their locking positions shown in full line in FIG. 3. Pivotal movement of the jaws beyond their illustrated locking positions is constrained by engagement of the jaw front end portions with a rim portion 64*a* of end cap 64, which is removably or permanently affixed, as desired, to housing rim portion 74.

In accordance with the presently preferred construction, tooth elements 58*c* and 58*c'* are formed by a screw threading device such that their contours conform with and serve to threadably receive screw threads 50*c* when jaws 58 and 58' are disposed in their locking positions. Also, in accordance with such construction, jaw front end portions 58*a* and 58*a'* are formed substantially larger than rear end portions 58*b* and 58*b'* in order to employ centrifugal force as a supplement to the bias of O-ring 60 for maintaining the jaws in their locking positions, during driven rotations of housing 56.

Now making reference to FIGS. 2 and 3, it will be noted that arbor 62 is formed with a first or fixture mounting end portion 62*a*, which is sized to be received within rear opening recess 72, and a second or power source mounting end portion 62*b*, which is sized to be slidably received within power tool insert 38. First end portion 62*a* may be releasably locked within recess 72 by any suitable means, such as may be defined by a set screw 86 and a side opening recess 62*c*. It will be noted that first end portion 62*a* is formed with a forwardly opening mounting recess 62*d*, which is sized to slidably receive the inserted end of bolt shank portion 50*b* and has an axial length sufficient to accommodate for insertion of the bolt shank end portion when the bolt is employed to mount a thin grinding element, such as the conventional sanding disc to be hereinafter described with reference to FIG. 5, or an otherwise formed grinding element having a through aperture of some given minimum length. Thus, the present construction permits use of a single bolt to mount separate grinding elements having substantially different thicknesses.

Again referring to FIG. 3, it will be noted that end cap 64 is also formed with a centrally located mounting sleeve portion 64*b* fixed concentrically of rim portion 64*a* by a radially extending web portion 64*c*. Portions 64*a*, 64*b* and 64*c* cooperate to form a forwardly opening annular recess 64*d*, which serves to mount resiliently deformable member 54, whereas sleeve portion 64*d* serves to define a through opening 64*e*, which is sized to slidable receive bolt shank portion 50*b*. It will be understood that mounting opening 64*e* and mounting/clearance recess 62*d* serve as continuations of housing mounting opening 68 and cooperate therewith to support shank end portion 50*b* throughout substantially its entire length.

Grinding element 12 may be releasably coupled to adapter 10 for driven rotation by power source 14 by inserting bolt shank portion 50*b* through grinding element aperture 20 and subsequently into housing mounting opening 68 by an amount sufficient to both lockingly engage with jaws 58 and 58' and resiliently deform member 54, as indicated in FIG. 3. The resilient deformation of member 54 establishes a bias acting axially of bolt 50, which serves to maintain screw threads 50*c* in firm frictional seating engagement with jaw tooth elements 58*c* and 58*c*', and constrain both bolt 50 and grinding element 12 for rotation with housing 56. Preferably, the insertion/locking procedure involves first applying finger pressure to jaw end portions 58*a* and 58*a*' in order to place the jaws in their release positions shown in broken line in FIG. 3 to permit manual insertion of bolt end portion 50*b* without wearing engagement between jaw tooth elements 58*c* and 58*c* ' and screw threads 50*c*. After insertion of the bolt, the jaws are released to permit same to assume their normal locking position and the operation completed by using hand pressure to force the grinding element axially towards the housing 56 to compress member 54, while simultaneously imparting a slight clockwise directed rotational movement to both the grinding element and bolt. As will be apparent, such clockwise directed rotational movement will effect further threaded insertion of the bolt into mounting opening 68, such that when hand pressure is removed member 54 will remain in a slightly compressed state and in frictional engagement with the grinding element.

While the cooperating screw threaded connection between locking jaws 58 and 58' and bolt 50 will tend to tighten the bolt during driven rotations of housing 56, much in the same fashion as properly threaded lugs on a vehicle wheel, it has been found that absent the provision of member 54, undesired relative rotations will nonetheless likely occur between the bolt and grinding element under actual operating conditions. In addition to preventing relative rotation between the grinding element and bolt during a grinding operation, member 54 also serves to constrain unthreading rotations of the bolt, which might otherwise occur in the event of tool power failure while the grinding element is engaged with a workpiece. Under certain conditions, such unthreading rotations would be sufficient to effect complete separation of the bolt and grinding element from the fixture, and thereby result in injury to an operator. In any event, the driving connection between the bolt and grinding element would be lost as a result of power shut off and the bolt would simply spin relative to the grinding element when power is restored or turned on.

Alternatively, the insertion/locking procedure may be effected by simply striking enlarged head portion 50*a* of a partially inserted bolt against a solid object, such as a work bench, with a force sufficient to drive the bolt fully into mounting opening 68 and effect compression of member 54. However, this procedure is not desirable in that the locking jaws will be forced to ratchet as the bolt is inserted and a wearing away of the jaw portions and/or screw threads of the bolt encountered.

Removal of a grinding element for replacement purposes may be effected by applying hand pressure to the grinding element in order to effect further deformation of the resiliently deformable member by an extent required to remove the frictional coupling between the screw threads and the locking jaws, and thereafter imparting a slight counter-clockwise directed rotational movement to the grinding element in order to unthread the bolt by an amount sufficient to permit the resiliently deformable member to return to its non-deformed state when pressure is released therefrom. Thereafter, the locking jaws may be easily moved by finger pressure to their unlocking or release positions and the bolt simply pulled out of the housing.

As by way of specific example, an adapter of the present invention has been built and tested with satisfactory results, using a conventional $\frac{1}{4}''$ diameter machine bolt and a resiliently deformable member formed of relatively soft rubber deformable under finger pressure.

As will be apparent from the foregoing, the provision of the screw threaded coupling between the bolt and locking jaws simplifies both locking and unlocking of the grinding element relative to the housing. It is however contemplated that the screw threads may be replaced by other locking recess means, such as may be defined by annular locking grooves or suitably patterned serrations with which appropriately designed jaw tooth elements are intended to cooperate for locking purposes. However, a drawback in the provision of these latter locking recess means is that they fail to provide for infinite degree of adjustment of the compression of the resiliently deformable member, during the locking/unlocking operation characteristic of screw threads; and that in some cases make it more difficult to effect release thereof from the locking jaws.

Figure 5:
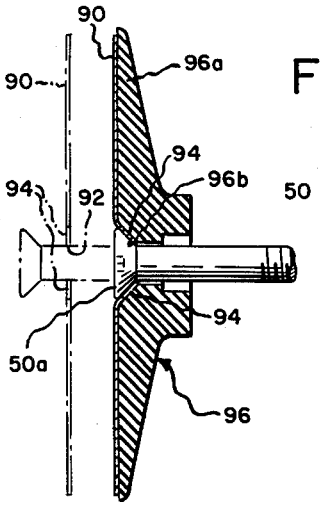
FIG. 5 is a sectional view showing the alternative form of the resiliently deformable member adapted for use with a sanding disc.

FIG. 5 illustrates an alternative form of the present invention, which is particularly adapted for use in mounting conventional sanding disc 90 of the type characterized as having a centrally located through aperture 92 and two or more connecting slots 94 serving to facilitate deformation of portions of the disc surrounding aperture 92 upon insertion of bolt 50 in the manner illustrated in full line in FIG. 5. In accordance with this form of the invention, previously described resiliently deformable member 54 is removed from within end cap recess 64*d* and replaced by resiliently deformable member 96, which is characterized as being formed with a radially extending sanding disc back-up portion 96*a* and a centrally located frustoconically shaped recess 96*b*, which cooperates with bolt head portion 50*a* to deform and clampingly secure sanding disc 90 in position. The mode of operation of this form of the invention is, however, identical to that previously described with reference to FIGS. 1–4.

Figure 6:
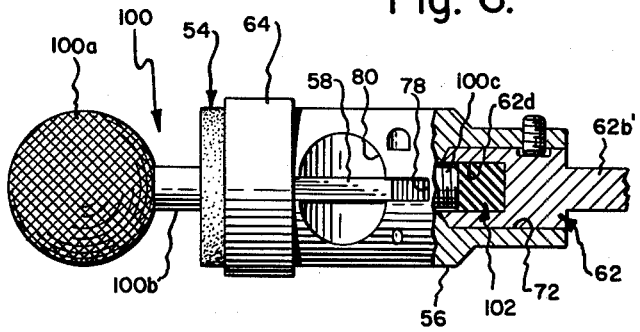
FIG. 6 is a view similar to FIG. 2, but showing a modified construction particularly adapted for use with grinding elements of the type permanently fixed to a drive shaft.

FIG. 6 illustrates a further alternative form of the present invention, which is particularly adapted for use in mounting a grinding element, such as a "mounted point" 100, which is characterized as having a grinding head portion 100*a* permanently fixed to a drive shaft or mounting shank 100*b*. Mounted point 100 departs from a conventional construction in that its normally smooth mounting shank 100*b* is provided with a screw threaded portion 100*c* or other suitable locking recess means of the type mentioned above in order to permit locking engagement thereof with jaws 58 and 58'. In accordance with this form of the invention, an additional resiliently deformable member in the form of a rubber or plastic plug or insert 102 is fitted within arbor mounting recess 62*d* and adapted to be deformed incident to insertion of mounting shank 100*b*. Thus, plug 102 serves the same function as previously described member 54 in that it serves to provide a resilient bias tending to retain the locking jaws in locking engagement with threaded portion 100*c* and prevent unintended unthreading rotations of the drive shaft.

FIG. 6 also illustrates a modified construction of arbor 62, wherein its second or power tool mounting end portion 62*b*' is sized for receipt within a chuck of a conventional electric drill or the like, not shown, as opposed to the form of tool illustrated in FIG. 1.

While the embodiment of the invention shown in FIG. 6 is intended to accommodate grinding elements of the type having integrally formed or permanently affixed drive shafts, it will be uderstood that the embodiment of the invention shown in FIGS. 1–4 may also accommodate certain of such grinding elements having drive shaft lengths and grinding head configurations permitting engagement of the latter with member 54.

Figure 7:
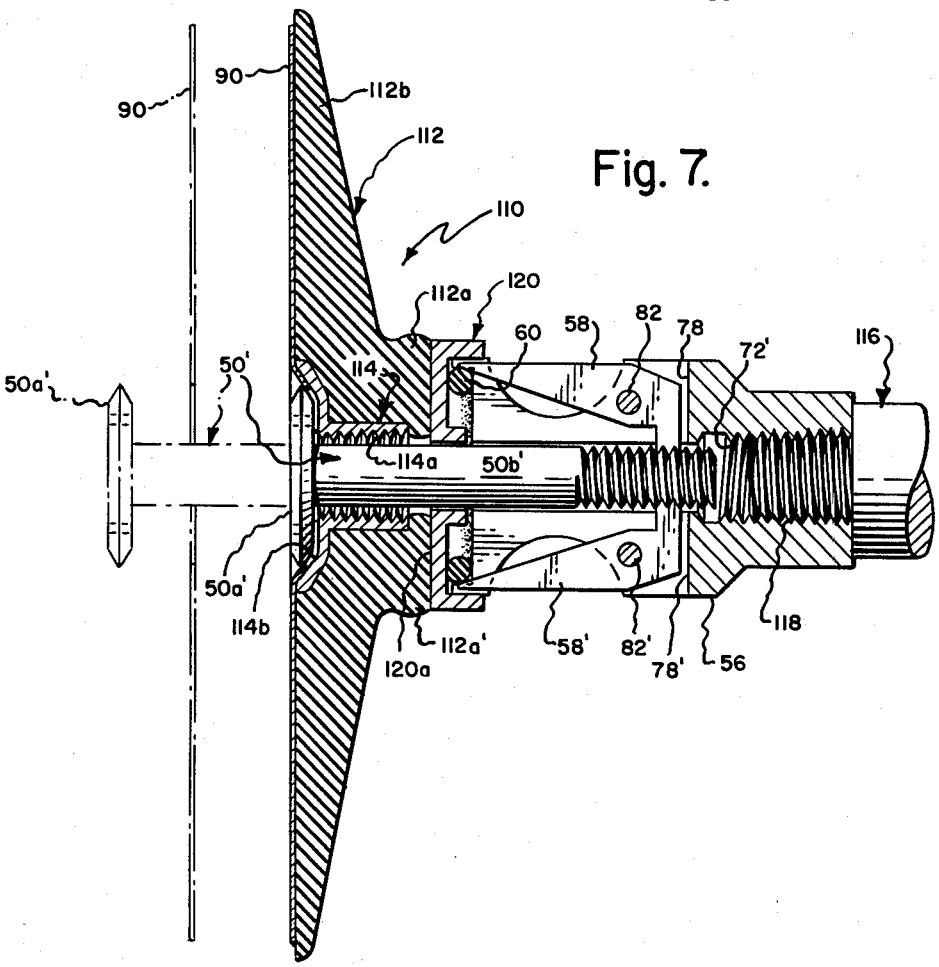
FIG. 7 is a sectional view showing a further alternative form of the present invention.

FIG. 7 illustrates a still further alternative form of the present invention, which permits mounting of a conventional sanding disc mounting head generally designated as 110. Head 110 normally comprises a resiliently deformable member or body 112 having a hub portion 112*a* and a radially extending backup portion 112*b*, and a metal hub 114 having a screw threaded mounting aperture 114*a* and a forwardly facing clamping recess 114*b*. It will be understood that head 110 is of the type normally intended to be fixed directly to the drive shaft 116 of a suitable power source by threading metal hub 114 onto the threaded end 118 of such drive shaft and locking same in assembled condition by subsequently threading a locking nut, not shown, onto such threaded end for receipt within recess 114*b*. The locking nut would normally cooperate with the wall of recess 114*b* for the purpose of securing an appropriately sized sanding disc 90 to the mounting head. In accordance with the embodiment of the invention illustrated in FIG. 7, the previously described end cap 64 is preferably replaced by a second end cap 120, which serves to define a relatively expansive bearing or clamping surface 120*a* disposed for engagement with hub portion 112*a* of head 112; and the previously described drive shaft in the form of bolt 50 is replaced by a bolt 50' whose head portion 50*a'* is comparable in size and shape to the above mentioned locking nut. Of course, shank portion 50*b'* of bolt 50' would be necessarily sized or formed with a stepped diameter permitting same to be slidably inserted through metal hub aperture 114*a* and into the housing mounting opening. It will be understood that the design of fixture body portion 56 may be modified as shown in FIG. 7 by forming its rear opening 72' with screw threads sized to permit mounting thereof on drive shaft 116 or identical to that shown in FIGS. 1–3 so as to permit removable mounting of head 110 on a power tool of the type described with reference to FIG. 1.

By again making reference to FIG. 7, it will be noted that hub portion 112*a*, which is shown at 112*a'* as being slightly deformed incident to the mounting operation, serves to perform the same function as previously described member 54, so as to permit such member to be dispensed with in this embodiment of the invention.

It is envisioned that the present adapter may be marketed in kit form with a sufficient number of interchangeable parts permitting selective mounting of diverse types of grinding elements illustrated in the drawings.

What is claimed is:

1. In the combination of a grinding element, a drive shaft for mounting said grinding element and being formed integrally therewith, a power source and means for mounting said grinding element and said drive shaft for driven rotation in a given direction by said power source; the improvement comprising in combination:

said drive shaft being formed with locking recess means; and said means for mounting said grinding element and said drive shaft includes a fixture having, a housing formed with a mounting opening sized to slidably receive said drive shaft, an arbor for connecting said housing to said source of power for driven rotation in said given direction, said arbor having a fixture mounting end portion formed with a recess, an opposite power source mounting end portion and means for removably coupling said fixture mounting end portion to said housing for conjunctive rotation and to position said recess in communication with said mounting opening, jaw means mounted on said housing for movement between release and locking positions, said jaw means being formed with tooth means arranged for receipt within said mounting opening for locking engagement with said locking recess means when said jaw means is in said locking position, and a resiliently deformable means disposed within said recess for engagement with an inserted end of said drive shaft and being subject to clamping deformation between said inserted end and said fixture mounting end portion incident to insertion of said drive shaft within said mounting opening to position said locking recess means in engagement with said tooth means, characterized in that deformation of said deformable means establishes a bias acting lengthwise of said drive shaft for releasably maintaining said tooth means and said locking recess means in surface engagement and constraining said drive shaft and said grinding element for rotation with said fixture.

2. In the combination of a grinding element, a drive shaft for mounting said grinding element, a power source and means for mounting said grinding element and said drive shaft for driven rotation in a given direction by said power source; the improvement comprising in combination:

said drive shaft being formed with locking recess means, and said means for mounting said grinding element and said drive shaft includes a fixture having a housing defining a mounting opening sized to slidably receive said drive shaft, a forwardly opening recess bounded by a front rim portion and arranged in communication with a forwardly disposed end of said mounting opening, and a pair of radially outwardly opening slots extending lengthwise of said mounting opening in communication therewith and said forwardly opening recess; means for connecting said housing to said power source for driven rotation in said given direction; jaw means mounted on said housing for movement between release and locking positions, said jaw means includes a pair of jaws arranged one within each of said slots, each of said jaws being of generally L-shaped configuration and having a manual operating front end portion projecting forwardly into said forwardly opening recess, a rear end portion defining tooth means arranged for receipt within said mounting opening for locking engagement with said locking recess means when said jaw means is in said locking position, and an intermediate portion pivotally coupled to said housing for mounting its jaw for movement between said release and locking positions, spring means positioned within said forwardly opening recess in engagement with said front end portion of each of said jaws for normally biasing said jaws into said locking positions, and a cap mounted on said front rim portion for defining a stop limiting outwardly directed movement of said front end portion of each said jaws beyond said locking position; and a resiliently deformable means disposed operably intermediate said fixture and one of said grinding element and said drive shaft for clamping deformation therebetween incident to insertion of said drive shaft within said mounting opening to position said locking recess means in engagement with said tooth means, characterized in that deformation of said deformable means establishes a bias acting lengthwise of said drive shaft for releasably maintaining said tooth means and said locking recess means in surface engagement and constraining said drive shaft and said grinding element for rotation with said fixture.

3. The improvement according to claim 2, wherein said grinding element is formed with a through aperture, said drive shaft is formed with an enlarged head end portion and a shank end portion, said shank end portion being formed with said locking recess means and sized to be inserted through said through aperture to position said head end portion in engagement with one surface of said grinding element, said means for connecting said fixture to said power source includes a rearwardly opening recess formed in said housing and arranged in communication with a rearwardly disposed end of said mounting opening and an arbor removably fixed within said rearwardly opening recess, said arbor is formed with a recess aligned with said rearwardly disposed end of said mounting opening and sized to slidably receive and inserted end of said shank end portion of said drive shaft, and said resiliently deformable means is carried by said cap for engagement with said grinding element.

4. The improvement according to claim 3, wherein said grinding element is a sanding disc, said head end portion of said drive shaft is formed with a frusto-conical shaped clamping surface, and said resiliently deformable means includes a hub portion fixed to said cap and an annular flange portion disposed to extend essentially radially co-extensive with said sanding disc, said hub portion being formed with a through opening sized to receive said shank end portion of said drive shaft and a frusto-conically shaped clamping surface cooperating with said clamping surface of said head end portion for clamping said sanding disc therebetween.

5. The improvement according to claim 2, wherein said drive shaft is formed integrally with said grinding element, said means for connecting said fixture to said power source includes an arbor removably fixed within a rearwardly opening recess formed in said housing and arranged in communication with a rearwardly disposed end of said mounting opening, said arbor is formed with a recess aligned with said rearwardly disposed end of said mounting opening, and said resiliently deformable means is disposed within said recess of said arbor for engagement with an inserted end of said drive shaft.

6. The improvement according to claim 2, wherein said grinding element is formed with a through aperture, said drive shaft is formed with an enlarged head end portion and a shank end portion, said shank end portion being formed with said locking recess means and sized to be inserted through said through aperture to position said head end portion in engagement with one surface of said grinding element, said means for connecting said fixture to said power source includes a threaded recess opening through an end of said housing disposed remotely from said forwardly opening recess, and said resiliently deformable means is disposed intermediate said cap and said grinding element.

7. The improvement according to claims 2, 3, 4, 5 or 6, wherein said locking recess means is a screw thread, said tooth means includes a plurality of tooth elements sized and shaped for conforming engagement with said screw thread, and said screw thread is turned in a direction tending to thread said drive shaft into said mounting opening incident to rotation of said fixture in said given direction with said tooth elements engaged with said screw thread.

8. An adapter for permitting quick change mounting of a conventional sanding disc and sanding disc mounting head on a power source of the type having a screw threaded drive shaft driven for rotation in a given direction, said sanding disc being characterized as having a centrally located aperture sized to receive said drive shaft, said mounting head being characterized as having a mounting sleeve formed with a threaded through opening for threadably receiving said drive shaft and a sanding disc clamping recess disposed adjacent one end of said through opening and a resiliently deformable body formed with a hub portion enclosing said sleeve and a flange portion sized to be essentially radially coextensive with said sanding disc, said adapter comprising:

a bolt having a clamping head portion and a shank portion formed with screw threads and sized to be inserted through said aperture and said threaded opening to position said head portion in cooperative association with said clamping recess for releasably clamping said sanding disc therebetween; and a fixture formed with a recess threaded to removably receive said drive shaft, a mounting opening sized to slidably receive said shank portion, jaw means having tooth means and being mounted on said fixture for movement between release and locking positions, resilient means for biasing said jaw means into said locking position wherein said tooth means is arranged within said mounting opening for engagement with said screw threads, said resilient means being deformable to permit movement of said jaw means from said locking position incident to engagement of said screw threads with said tooth means during insertion of said shank portion into said mounting opening and to manual pressure exerted on said jaw means by an operator of said adapter, characterized in that said fixture cooperates with said head portion of said bolt to clampingly deform said resiliently deformable body of said mounting head incident to insertion of said shank portion within said mounting opening to position said screw threads in engagement with said tooth means, in that said screw threads are turned in a direction tending to thread said bolt into said mounting opening while engaged with said tooth means and incident to rotation of said fixture in said given direction, and in that deformation of said resiliently deformable body of said mounting head establishes a bias acting axially of said shank portion for releasably maintaining said tooth means and said screw threads in surface engagement and constraining said sanding disc, said mounting head and said bolt for rotation with said fixture.

* * * * *